United States Patent [19]

Murao

[11] 3,940,825

[45] Mar. 2, 1976

[54] CLEANING MACHINE FOR BOBBINS WITH WASTE SLIVERS

[76] Inventor: Yoshio Murao, 55 Masuizumimati, Kanazawa, Ishikawa Pref., Japan

[22] Filed: June 27, 1974

[21] Appl. No.: 483,795

[30] Foreign Application Priority Data

Aug. 4, 1973 Japan ..... 48-92206[U]

[52] U.S. Cl. ..... 15/306 B; 15/97 R; 15/308

[51] Int. Cl.[2] ..... A47L 5/34

[58] Field of Search ..... 15/303, 306 R, 306 B, 308, 15/309, 97 R, 306 A

[56] References Cited

UNITED STATES PATENTS

| | | | |
|---|---|---|---|
| 1,681,556 | 8/1928 | Parker | 15/308 X |
| 1,947,748 | 2/1934 | Van Wormer | 15/308 |
| 2,115,107 | 4/1938 | Hoffeld | 15/306 B X |
| 2,184,567 | 12/1939 | Rundell | 15/309 X |
| 2,670,521 | 3/1954 | Turley | 15/308 X |
| 2,963,389 | 12/1960 | Winkler | 15/306 B X |

*Primary Examiner*—Harvey C. Hornsby
*Assistant Examiner*—C. K. Moore
*Attorney, Agent, or Firm*—Darby & Darby

[57] ABSTRACT

A machine for automatically removing waste slivers from bobbins includes means for supplying bobbins with waste slivers or fibers to a moving endless belt which causes the bobbins to rotate, suction means for removing the slivers that were loosened by the belt, another moving endless belt having a pile that loosens and removes the remaining waste slivers from the rotating bobbins, and means for collecting the removed slivers in closed containers.

5 Claims, 3 Drawing Figures

CLEANING MACHINE FOR BOBBINS WITH WASTE SLIVERS

BACKGROUND OF THE INVENTION

Manufacture of fabrics from natural fibers involves several complicated processes for processing the natural fibers into yarns which are then woven into fabrics. Although the processes differ for different fibers, such as wool or cotton, there are certain common features if the natural fibers are short. The fibers may be used for a yarn if they have surfaces that will cohere to each other thus permitting the fibers to adhere to each other. The process of producing yarn may from these fibers be thought of as beginning with carding. The carding process takes a large mass of the short natural fibers which are scattered in essentially a random manner and disentangles the fibers and arranges them in a more ordered and parallel arrangement. If the fiber is cotton, numbers of now somewhat parallel fibers are brought together to form what is known as a sliver after having been carded. The slivers, however, contain fibers that are still not arranged in a parallel fashion as well as fibers that are too short to form the high quality yarn needed for good fabrics. To remove the short or waste fibers and to make the fibers more nearly parallel, the sliver is passed through pairs of drafting rollers. Each successive pair of drafting rollers rotates more rapidly than the previous pair. As a result, the fibers are drawn out with respect to each other and become more nearly parallel and the shortest fibers drop out.

The slivers are then wound upon bobbins. The bobbin is typically cylindrical in shape with a central bore through its length enabling it to be placed on a spindle. After the drafting process, the fibers such as cotton or wool, are typically put through another process known as spinning in which the fibers are again drawn out, a twist given to the fibers to give them strength, and then they are again wound on a bobbin. The final product of the spinning process is a yarn from which the desired fabric is woven.

It is generally desirable to remove the very short fibers so they will not be present in the final yarn since yarns using only long fibers are stronger and produce finer fabrics than yarns that also use short fibers. Some of the short fibers or waste slivers are removed during each stage. However, not all of the waste fibers are removed in the spinning or the drafting process and some waste fibers will be wound upon the bobbins in each stage and left there after the other fibers have been unwound from the bobbin. To maintain the high quality of these finished product, these waste fibers or slivers must be removed from the bobbin before the bobbin is used again to eliminate the possibility that the waste slivers will form part of the finished yarn and degrade its quality. After removal from the bobbins, the waste slivers should be collected in suitable storage units. This prevents the slivers from again being picked up by the bobbins and also minimizes the inhalation of slivers by textile workers in the factory, which constitutes a health hazard.

SUMMARY OF THE INVENTION

It is an object of the present invention to provide a machine for automatically removing waste slivers from bobbins.

It is a further object of the present invention to collect automatically the waste slivers after they have been removed from the bobbins.

It is a still further object of the present invention to supply bobbins automatically to the cleaning apparatus.

Other and further objects of the present invention will become apparent from consideration of the following description and the appended drawings in which:

BRIEF DESCRIPTION OF THE PREFERRED EMBODIMENT

Figure 1:
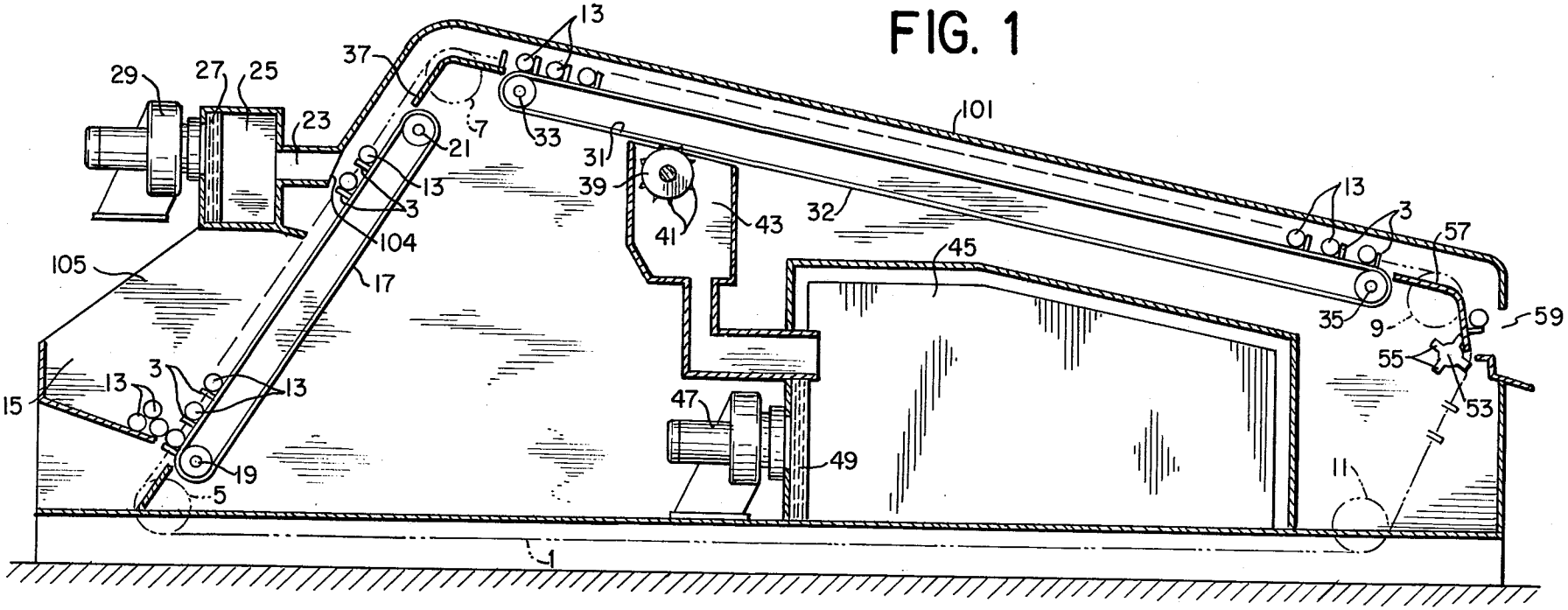
FIG. 1 is a side elevational view of the machine.

The machine is shown generally in cross section in FIG. 1. It is surrounded by an enclosure 101 which rests on the floor 103. An endless chain 1 moves around and is maintained in proper position by four rotatably mounted sprocket wheels 5, 7, 9 and 11. The mounting of the wheels is not shown. At least one of the wheels is driven by any suitable means such as an electric motor and chain 1 moves in a clockwise direction. A plurality of conveyor lugs 3 having lengths suitable to support a bobbin are attached to chain 1 by suitable means (not shown) perpendicular to its direction of motion. Conveyor lugs 3 are, in a preferred embodiment, spaced apart a distance greater than the diameter of a typical bobbin but less than the diameter of two bobbins. This spacing and the height of the conveyor lugs 3 ensures that only one bobbin 13 is positioned between adjacent conveyor lugs. This ensures that each bobbin will be in contact with the endless belts (described below) and that each bobbin can rotate with respect to the endless belts without hindrance from another bobbin.

At one end of the machine is positioned a hopper 15 having an interior surface located near chain 1. Hopper 15 has an opening 105 through which the bobbins that are to be cleaned may be inserted so that they lie generally parallel to conveyor lugs 3. An endless belt 17 moves in a generally vertical direction about rollers 19 and 21, one of which is driven by suitable means (not shown) so that belt 17 moves in the same direction as chain 1. Belt 17 is positioned so that its entire upper surface is positioned adjacent and parallel to chain 1. Near the uppermost position of endless belt 17 is a duct 23 which opens into a larger chamber 25. At the end of chamber 25 opposite duct 23 is a filter 27 which collects the slivers after their removal from the bobbins 13. A blower 29 is positioned such that the filter 27 is between chamber 25 and blower 29 and is directed so that it exhausts air from chamber 25. In a preferred embodiment, chamber 25 is positioned on the top surface of hopper 15.

Figure 3:
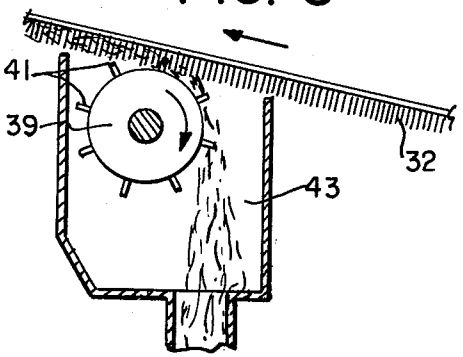
FIG. 3 is a side elevational view showing the removal of slivers from the endless belt.
Figure 2:
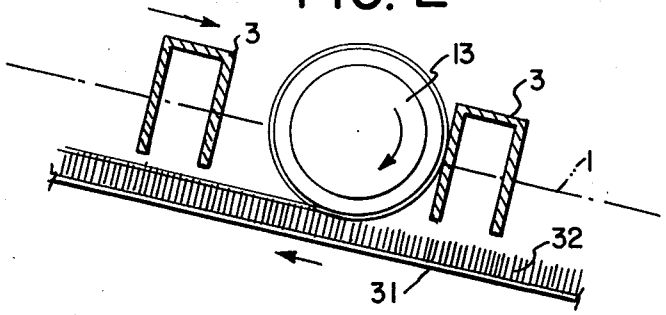
FIG. 2 is a side elevational view showing the removal of slivers from the bobbin by the pile of an endless belt.

A second endless belt 31 moves about rollers 33 and 35 at least one of which is driven by any suitable means. Belt 31 has a pile-like material 32 on its outer surface. This is shown in detail in FIGS. 2 and 3. Roller 33 is positioned near roller 21 with the gap between rollers 21 and 33 covered by a curved plate 37. Roller 33 is positioned near roller 21 with the gap between rollers 21 and 33 covered by a curved plate 37. Roller 35, in a preferred embodiment, is positioned lower than roller 33 and belt 31 has its entire upper surface positioned immediately underneath and parallel to chain 1.

Located underneath the bottom surface of endless belt 31 is a rotatably mounted stripping roller 39 having a plurality of combs 41 which contact the pile 32 of endless belt 31. In a preferred embodiment, stripping roller 39 is located in chamber 43 which is connected to fiber collecting room 45. A blower 47 communicates with and exhausts the air from fiber collecting room 45 through a filter 49 which is suitable for collecting waste fibers.

Near roller 35, but in a lower position, is delivery wheel 53 which is placed close to opening 59 located in the surface of enclosure 101. Delivery wheel 53 is rotatably mounted in any suitable fashion and has a plurality of arms 55 extending from its axis of rotation. A suitably shaped plate 57, of any suitably strong material, is placed between roller 35 and delivery wheel 53 to cover the otherwise open space between the lower portion of belt 31 and delivery wheel 53.

Chain 1 and conveyor lugs 3 move in a generally clockwise direction. As conveyor lugs 3 move through the interior space of hopper 15, each space between adjacent conveyor lugs will be occupied, provided that there is a sufficient number of bobbins in the hopper, by a single bobbin 13. Rollers 19 and 21 are also rotating in a generally clockwise manner but at a speed sufficiently great that belt 17 is moving more rapidly than chain 1. The difference in speeds between chain 1 and belt 17 forces bobbins 13 to rotate in a counter-clockwise direction and tends to loosen the slivers. Some of the slivers are entirely removed from bobbin 13 and are picked up by belt 17. Near the uppermost position of belt 17 is located duct 23 past which the bobbins pass. Blower 29 acts as a suction device and the lowered air pressure it creates draws the loose waste slivers from the bobbins 13 and belt 17 through an opening 104 in the enclosure through duct 23 into chamber 25 where they are trapped by filter 27. To prevent the fibers from getting into the blower 29 or from escaping into the working environment, filter 27 should extend across the entire lateral cross section of chamber 25 and duct 23 should fit snugly into the enclosure 101. In a preferred embodiment, chamber 25 is located on top of hopper 15 and blower 29 is suitably mounted to chamber 25.

At the top of belt 17, bobbins 13 move on to plate 37 which is spaced between belts 17 and 31 and directly underneath chain 1 to prevent the bobbins 13 from falling into the gap between the two endless belts.

Endless belt 31 is forced to move in a counter-clockwise direction by the counter-clockwise rotation of either roller 33 or 35. Bobbins 13, maintained in position between conveyor lugs 3 are therefore caused by the movement of belt 31 to rotate in a clockwise direction. As the bobbins 13 rotate, the ends of the waste slivers on the bobbins 13 are picked up by the pile 32 of endless belt 31 and the entire waste sliver is removed from bobbin 13. This is shown in detail in FIG. 2.

The waste slivers that are removed from bobbins 13 by belt 31 must be removed from belt 31 to permit the pile to continue efficient cleaning of the bobbins. In a preferred embodiment, this is accomplished by the stripping roller 39 and combs 41 located on the underside of endless belt 31 in compartment 43. Stripping roller 39 rotates in a clockwise direction at a higher speed than endless belt 31. The combs 41 thus move more rapidly than belt 31 and remove the waste slivers from the pile 32 on endless belt 31. The waste slivers fall off combs 41 and are drawn into fiber collecting room 45 by gravity and blower 47 which is arranged to exhaust air. Filter 49 in fiber collecting room 45 retains the waste fibers in fiber collecting room 45 and prevents their escape from the machine into the working area or into blower 47.

Delivery wheel 53 is mounted so that it rotates as successive conveyor lugs 3 strike one of its arms 55. As it rotates, another arm 55 is caused to strike a bobbin 13 resting on the conveyor lug 3 to knock the bobbin through an opening 59 in enclosure 101. After the bobbins leave the cleaning machine through opening 59, they may be collected in any suitable container.

Although a preferred embodiment of the invention has been described, certain variations will be obvious to one having ordinary skill in the art, and it is therefore intended that the invention not be limited to the particular embodiment herein described, but rather that the scope of the invention should be determined by reference to the appended claims.

What is claimed is:

1. Apparatus for removing waste fibers from bobbins, comprising:

an endless chain drivable about a predetermined path of movement having mounted thereon a plurality of lugs spaced apart in the direction of movement of said chain, the distance between said lugs being greater than the diameter of a bobbin, a hopper for receiving said bobbins and feeding said bobbins to the spaces of said chain between said lugs, a first drivable endless belt, means for driving said first endless belt said first belt having a surface positioned with respect to a first portion of said path of movement said endless chain so as to provide a support surface for the bobbins positioned between said lugs, a first chamber, said first chamber having an opening near said first endless belt, a first blower connected to said first chamber, said first blower being directed to exhaust air from said first chamber, said opening being positioned such that waste fibers are removed from said bobbins by the flow of air into said opening, a second drivable endless belt beneath a second portion of said path of movement said endless chain, means for driving said second endless belt, said second endless belt having a surface positioned with respect to said second portion of said endless chain to provide a support surface for bobbins positioned between said lugs, said second endless belt being driven at a velocity different from that of said endless chain, said second endless belt having a pile-like surface for removing waste fibers from said bobbins, means for directing said bobbins from said first endless belt to said second endless belt, a roller having a plurality of combs thereon positioned in proximity to said second endless belt for removing waste fibers from said pile-like surface of said second belt, a second chamber enclosing said roller, and means for exhausting air from said second chamber.

2. Apparatus as recited in claim 1 wherein said means for driving said first belt drives said belt faster than said chain.

3. Apparatus as recited in claim 2 wherein said second chamber further includes a filter, said filter being positioned to trap waste fibers within said second chamber.

4. Apparatus as recited in claim 1 wherein said first chamber further includes a filter, said filter being positioned to trap waste fibers within said first chamber.

5. Apparatus as recited in claim 1 wherein said means for driving said second belt drives said second belt in a direction opposite to the direction of motion of said chain.

* * * * *